US011381897B2

(12) United States Patent
Ko et al.

(10) Patent No.: US 11,381,897 B2
(45) Date of Patent: Jul. 5, 2022

(54) VARIABLE EARTIP FOR EARPHONE

(71) Applicant: ALMUS Corp., Chungcheongnam-do (KR)

(72) Inventors: Ju Heon Ko, Gyeonggi-do (KR); Jong Won Lee, Incheon (KR); Byung Il Min, Gyeonggi-do (KR); Yun Uk Ha, Incheon (KR); Jeong Kwon Park, Gyeonggi-do (KR); Won Kil Yang, Gyeonggi-do (KR)

(73) Assignee: ALMUS Corp., Chungcheongnam-do (KR)

( * ) Notice: Subject to any disclaimer, the term of this patent is extended or adjusted under 35 U.S.C. 154(b) by 0 days.

(21) Appl. No.: 17/172,312

(22) Filed: Feb. 10, 2021

(65) Prior Publication Data

US 2022/0070572 A1 Mar. 3, 2022

(30) Foreign Application Priority Data

Aug. 27, 2020 (KR) ..... 10-2020-0108278

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC ..... H04R 1/1016; H04R 25/60; H04R 1/10; H04R 25/652; H04R 2225/025; H04R 2225/77
See application file for complete search history.

(56) References Cited

U.S. PATENT DOCUMENTS 2,489,277 A * 11/1949 Faralla ..... H04R 1/1016 181/22
3,527,901 A * 9/1970 Geib ..... H04R 25/60 381/328
4,539,440 A * 9/1985 Sciarra ..... H04R 25/656 381/329
7,014,010 B2 * 3/2006 Widmer ..... A61F 11/008 181/130

(Continued)

FOREIGN PATENT DOCUMENTS

CN 107040839 A * 8/2017
CN 108471584 A * 8/2018

(Continued)

*Primary Examiner* — Ryan Robinson
(74) *Attorney, Agent, or Firm* — Harness, Dickey & Pierce, P.L.C.

(57) ABSTRACT

Disclosed is an eartip for an earphone. The eartip includes a fixing portion formed to have a cylindrical shape with a bottom fixedly coupled to a nozzle of an earphone, a variable portion formed to have a cylindrical shape with a bottom coupled to a top of the fixing portion and to have a length and bending which are variable, and a contact portion formed of a flexible material and including an inner section having a cylindrical shape with a bottom coupled to a top of the variable portion and an outer section extending to be rounded downward from a top end of the inner section to surround at least parts of the inner section, the variable portion, and the fixing portion and to come into contact with an external auditory meatus of a user's ear.

8 Claims, 16 Drawing Sheets

(56) References Cited

U.S. PATENT DOCUMENTS 7,362,875 B2 * 4/2008 Saxton ..... H04R 25/656 381/322
7,425,196 B2 * 9/2008 Jorgensen ..... H04R 25/456 600/25
7,561,710 B2 * 7/2009 Frederiksen ..... H04R 25/658 381/322
7,889,881 B2 * 2/2011 Ostrowski ..... H04R 1/1016 381/329
8,348,011 B1 * 1/2013 Huang ..... H04R 25/656 181/135
8,467,556 B2 * 6/2013 Shennib ..... H04R 25/654 381/324
8,611,581 B2 * 12/2013 Matsuo ..... H04R 1/34 381/380
9,088,848 B2 * 7/2015 Abreu ..... G06F 1/163
9,883,280 B2 * 1/2018 Oosato ..... H04R 1/2857
10,182,281 B2 * 1/2019 Igarashi ..... H04R 1/1066
11,072,101 B2 * 7/2021 Huang ..... G10K 11/18
2002/0027996 A1 * 3/2002 Leedom ..... H04R 25/60 381/322
2007/0003096 A1 * 1/2007 Nam ..... H04R 1/1091 381/382
2008/0101637 A1 * 5/2008 Ho ..... H04R 25/00 381/328
2009/0232342 A1 * 9/2009 Oliveira ..... H04R 1/1016 381/382
2013/0259279 A1 * 10/2013 Hong ..... H04R 25/607 381/322
2016/0323665 A1 * 11/2016 Wickstrom ..... H04R 1/1075

FOREIGN PATENT DOCUMENTS

GB 2323295 A * 9/1998 ..... A61F 11/10
JP 2000300599 A * 10/2000
WO WO-2008125015 A1 * 10/2008 ..... H04R 1/1016

* cited by examiner (a)

(b)

(d)

(a)

(b)

(c)

(d)

(e)

VARIABLE EARTIP FOR EARPHONE

CROSS-REFERENCE TO RELATED APPLICATION

This application claims priority to and the benefit of Korean Patent Application No. 10-2020-0108278, filed on Aug. 27, 2020, the disclosure of which is incorporated herein by reference in its entirety.

FIELD

The present invention relates to a variable eartip used for an earphone.

BACKGROUND

In general, an earphone is used while being stuck in an ear of a user so that a speaker configured to convert an electrical signal generated by an audio system or a communication device into an acoustic signal is inserted into the ear to allow a sound of the speaker to be directly emitted inside the ear and to be heard by transmitting vibrations to a tympanum of the ear.

Since it is possible to hear sounds with less output while hardly doing harm to other people while hearing sounds using such earphones, earphones are generally used for hearing sounds output from a portable audio system such as a cellular phone, an MP3 player, and the like.

As described above, earphones used for providing sounds output from an audio system only to a user without bothering other people are classified into open-type earphones and kernel-type earphones depending on a part of an ear on which an earphone is mounted.

In open-type earphones, since an earphone unit is placed in an auricle, there are advantages of good wearability and less fatigue in an ear even in long-time use. However, when an earphone does not fit into a user's ear, the earphone may be loose and detached frequently. Also, there are disadvantages in which due to a low noise canceling ability, sound quality may be influenced and sounds may leak out.

Since a kernel-type earphone is inserted into an external auditory meatus of an ear and has sound insulation performance higher than that of an open-type earphone, sound is clear so as to be adequately used outdoors or a noisy place. An eartip for the kernel-type earphone is coupled to an earphone to transmit a sound output from the earphone to the inside of user's ear and is inserted into the ear and come into direct contact with the skin so as to improve wearability of the earphone, secure air-tightness, and block external noise.

However, since an external auditory meatus into which the eartip is inserted has a rather complicated shape as shown in FIG. 1, even when the eartip is formed of a flexible material, a pain may be caused by a pressure partially applied to the external auditory meatus. Also, since a shape and a size of the external auditory meatus such as a depth, a width, an angle, and the like are various for each person, it is impossible to provide uniform wearability and comfortability to users using eartips having a determined size and shape. To overcome this, two or three eartips having different sizes are provided with an earphone so as to allow a user to select an eartip adequate for the user among the eartips. However, there is still a limitation in providing eartips having a variety of shapes. Also, an eartip which is not selected is wasted which causes resource waste.

SUMMARY

The present invention is directed to providing a variable eartip configured to provide user-customized wearability and comfortability by adjusting a length and an angle of the eartip to be adequate for an earphone.

According to an aspect of the present invention, there is provided an eartip for an earphone. The eartip includes a fixing portion formed to have a cylindrical shape with a bottom fixedly coupled to a nozzle of an earphone, a variable portion formed to have a cylindrical shape with a bottom coupled to a top of the fixing portion and to have a length and bending which are variable, and a contact portion formed of a flexible material and including an inner section having a cylindrical shape with a bottom coupled to a top of the variable portion and an outer section extending to be rounded downward from a top end of the inner section to surround at least parts of the inner section, the variable portion, and the fixing portion and to come into contact with an external auditory meatus of a user's ear.

The variable portion may include a first section formed below and coupled to the top of the fixing portion, a second section formed above and coupled to a bottom of the inner section, and a third section located between the first section and the second section and having a length and bending which are variable.

The third section may be formed of a corrugated tube.

The first section may be coupled to the fixing portion while being inserted into an insertion groove formed along a periphery of a top end of the fixing portion.

The first section and the fixing portion may be coupled through insertion-injection molding, and the first section may include one or more holes formed therein.

The second section may be coupled to the inner section while being inserted into an insertion groove formed along a periphery of a bottom end of the inner section.

The second section and the inner section may be coupled through insertion-injection molding, and the second section may include one or more holes formed therein.

The fixing portion may include a groove portion recessed in at least one side surface from a top end so that an inside and an outside of the cylindrical shape may communicate with each other. Also, the first section may include a hole formed in a part corresponding to the groove portion.

The fixing portion may be formed of a flexible material, and hardness of the fixing portion may be higher than or equal to hardness of the contact portion.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1:
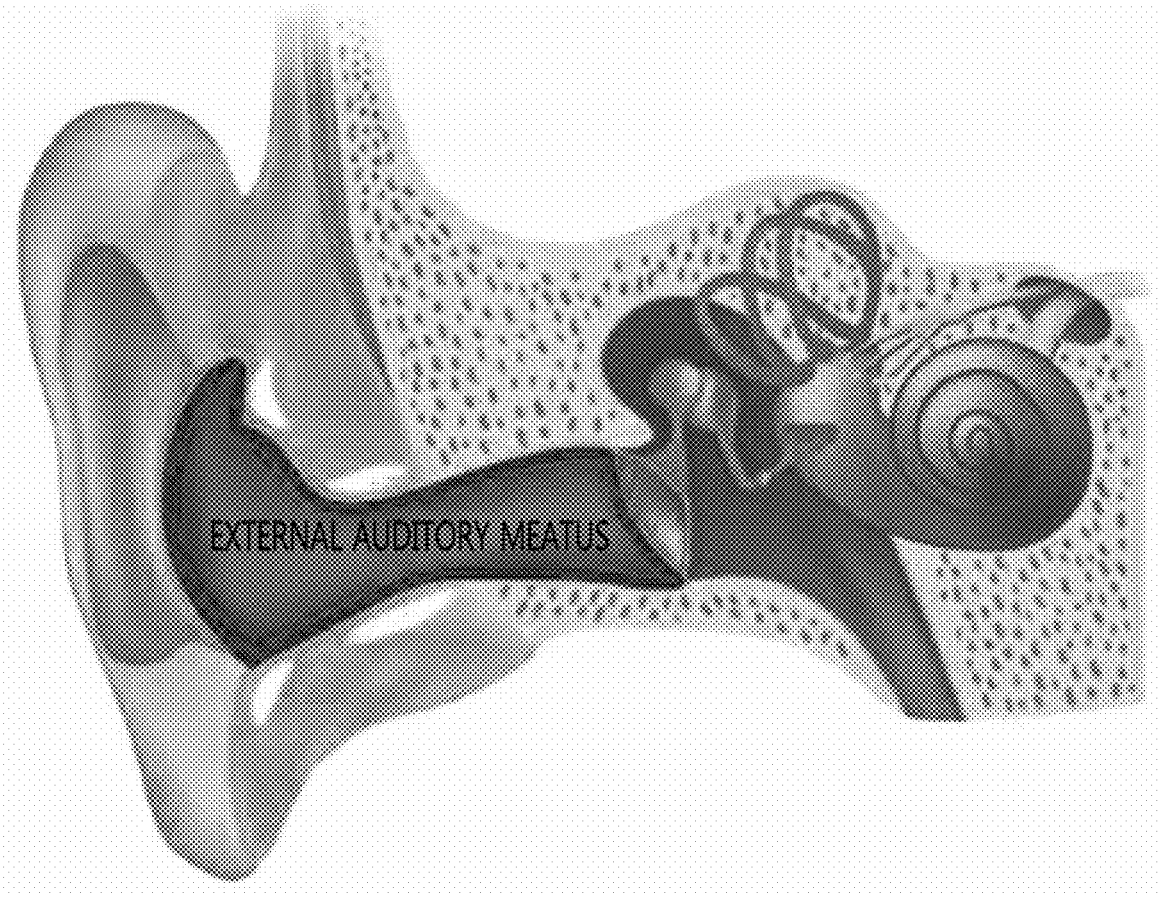
FIG. 1 illustrates an ear structure of a human which includes an external auditory meatus.

Hereinafter, exemplary embodiments of the present invention will be described in detail with reference to the drawings. Hereinafter, throughout the following description and the attached drawings, substantially like elements will be referred to as like reference numerals and a repetitive description thereof will be omitted. Also, in a description of the embodiments of the present invention, a detailed description of well-known functions or components of the related art will be omitted when it is deemed to obscure understanding of the embodiments of the present invention.

Figure 2A:
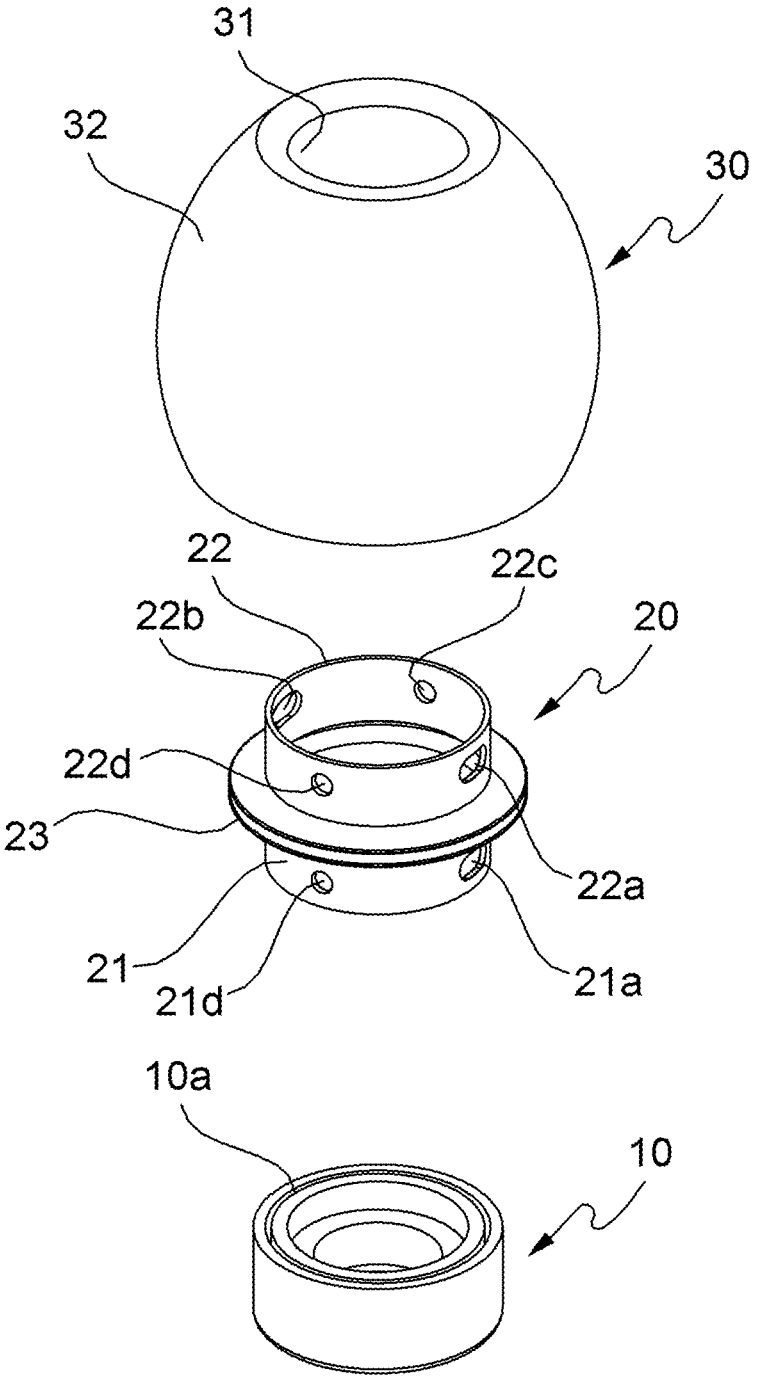
FIG. 2A is an exploded perspective view illustrating an eartip according to one embodiment of the present invention when viewed from above.
Figure 2B:
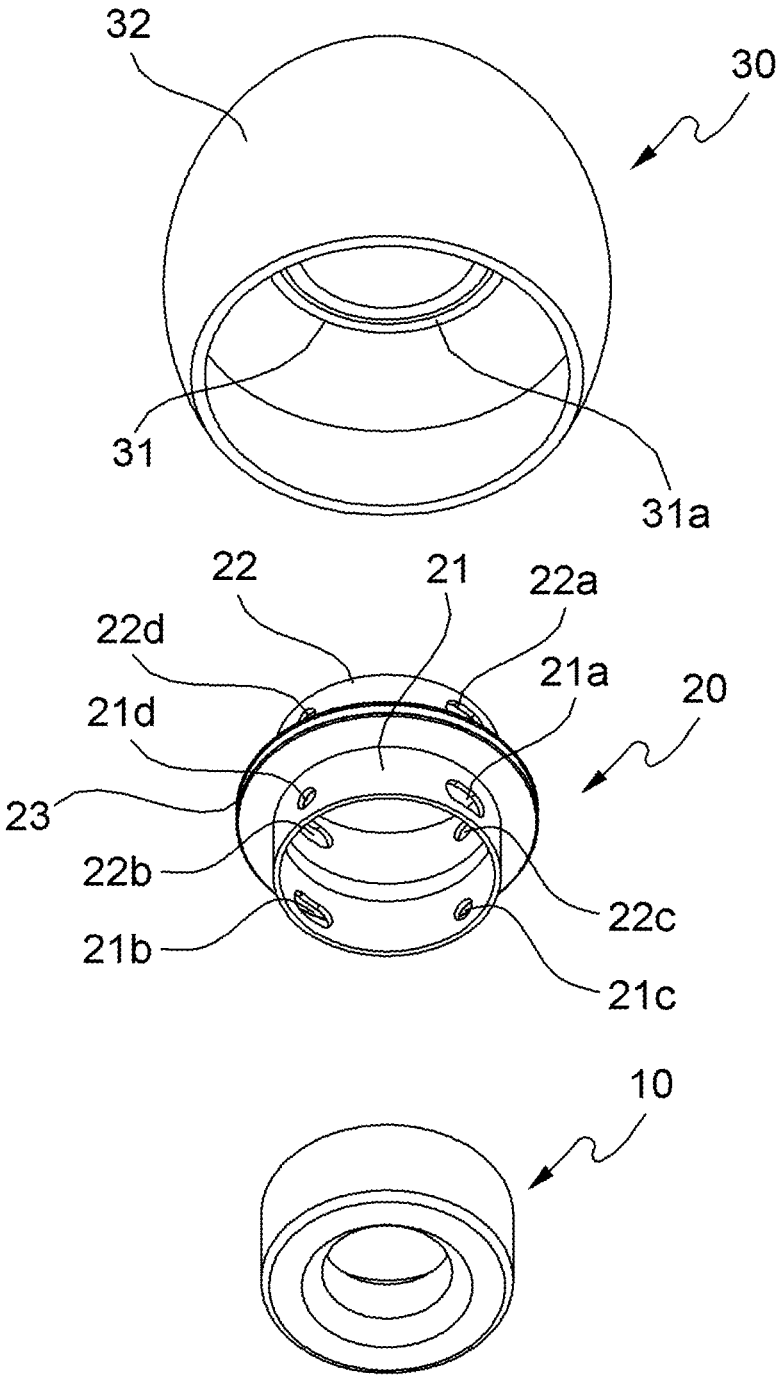
FIG. 2B is an exploded perspective view illustrating the eartip according to one embodiment of the present invention when viewed from below.
Figure 3:
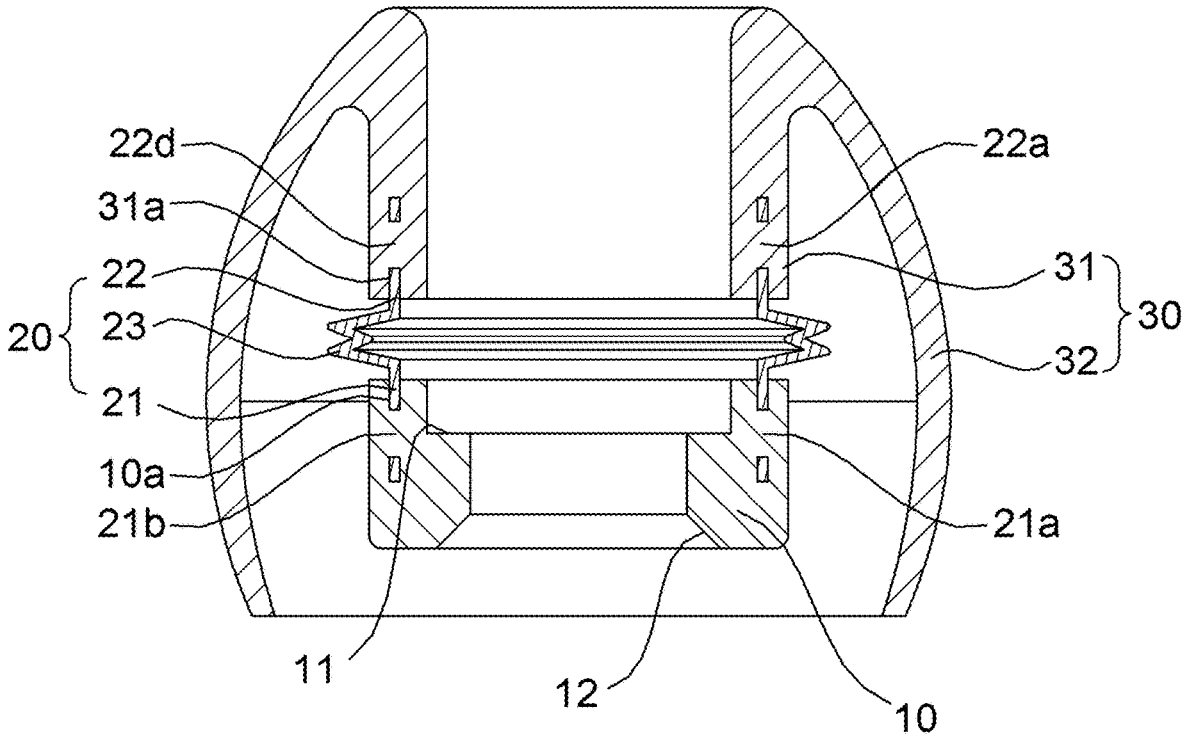
FIG. 3 is a cross-sectional view of the eartip according to one embodiment of the present invention.

FIGS. 2A to 3 are views of an eartip according to one embodiment of the present invention. FIG. 2A is an exploded perspective view of the eartip when viewed from above, FIG. 2B is an exploded perspective view of the eartip when viewed from below, and FIG. 3 is a cross-sectional view of the eartip.

The eartip according to the embodiment includes a fixing portion 10, a variable portion 20, and a contact portion 30.

The fixing portion 10 has a cylindrical shape with a bottom fixedly coupled to a nozzle of an earphone. The fixing portion 10 may include a step 11 formed thereinside not to be easily detached from the nozzle of the earphone and a tilted surface 12 at an inlet of a bottom end so as to easily insert the nozzle of the earphone thereinto.

The variable portion 20 has a cylindrical shape with a bottom coupled to a top of the fixing portion 10. The variable portion 20 is formed to have a length and bending which are variable to adjust a length and an angle of the eartip with respect to the earphone on which the eartip is mounted.

The contact portion 30 is formed of a flexible material such as silicone, rubber, and the like and includes an inner section 31 and an outer section 32. The inner section 31 has a cylindrical shape with a bottom coupled to a top of the variable portion 20. The outer section 32 is formed to extend and be rounded downward from a top end of the inner section 31 and surrounds at least parts of the inner section 31, the variable portion 20, and the fixing portion 10. The outer section 32 is a part which comes into contact with an external auditory meatus of a user's ear while the eartip is used.

The fixing portion 10 may be formed of a hard material or may be formed of a flexible material to allow the nozzle of the earphone to be easily insertable. When the fixing portion 10 is formed of a flexible material, the fixing portion 10 may have hardness higher than or equal to hardness of the contact portion 30 not to be easily detachable from the nozzle. For example, both the contact portion 30 and the fixing portion 10 are formed of silicone, hardness of silicone forming the fixing portion 10 may be higher than or equal to hardness of silicone forming the contact portion 30.

The variable portion 20 may include a first section 21 formed below, a second section 22 formed above, and a third section 23 located between the first section 21 and the second section 22.

The first section 21 is coupled to the top of the fixing portion 10. The second section 22 is coupled to the bottom of the inner section 31 of the contact portion 30.

The third section 23 is formed to have a length and bending which are variable. To this end, the third section 23 may be formed of a corrugated tube as shown in the drawings. The corrugated tube has advantages of having an easily variable length and of easily bending in a desired direction. In the embodiment, although the corrugated tube has two folds in the drawing, it is possible to design the corrugated tube has an adequate number of folds in consideration of a desired length or bending angle.

The first section 21 may be coupled to the fixing portion 10 while being inserted into an insertion groove 10*a* formed along a periphery of a top end of the fixing portion 10. In this case, the first section 21 and the fixing portion 10 may be coupled through insertion-injection molding. When the first section 21 and the fixing portion 10 are coupled through insertion-injection molding, the first section 21 may include one or more holes 21*a*, 21*b*, 21*c*, and 21*d* at a part to be inserted into the fixing portion 10 to prevent the first section 21 and the fixing portion 10 from being separated from each other. When the first section 21 and the fixing portion 10 are coupled through insertion-injection molding, the holes 21*a*, 21*b*, 21*c*, and 21*d* are filled with a material forming the fixing portion 10 so as to firmly fix the first section 21 to the fixing portion 10. However, instead of insertion-injection molding, the variable portion 20 and the fixing portion 10 may be separately formed and the first section 21 of the variable portion 20 may be attached to an outer circumference or inner circumference of the fixing portion 10 through thermosetting, ultrasonic fusion, adhesion, or the like.

The second section 22 may be coupled to the inner section 31 of the contact portion 30 while being inserted into an insertion groove 31*a* formed along a periphery of a bottom end of the inner section 31 of the contact portion 30. In this case, the second section 22 and the inner section 31 may be coupled through insertion-injection molding. When the second section 22 and the inner section 31 of the contact portion 30 are coupled through insertion-injection molding, the second section 22 may include one or more holes 22*a*, 22*b*, 22*c*, and 22*d* at a part to be inserted into the inner section 31 of the second section 22 to prevent the second section 22 and the inner section 31 from being separated from each other. When the second section 22 and the inner section 31 are coupled through insertion-injection molding, the holes 22*a*, 22*b*, 22*c*, and 22*d* are filled with a material forming the contact portion 30 so as to firmly fix the second section 22 to the inner section 31. However, instead of insertion-injection molding, the variable portion 20 and the contact portion 30 may be formed separately and the second section 22 of the variable portion 20 may be attached to an outer circumference or inner circumference of the inner section 31 through thermosetting, ultrasonic fusion, adhesion, or the like.

FIGS. 4A to 4D are cross-sectional views illustrating the eartip according to one embodiment of the present invention which is mounted on an earphone and illustrate examples of a length and an angle being adjusted according to the earphone.

Figure 4A:
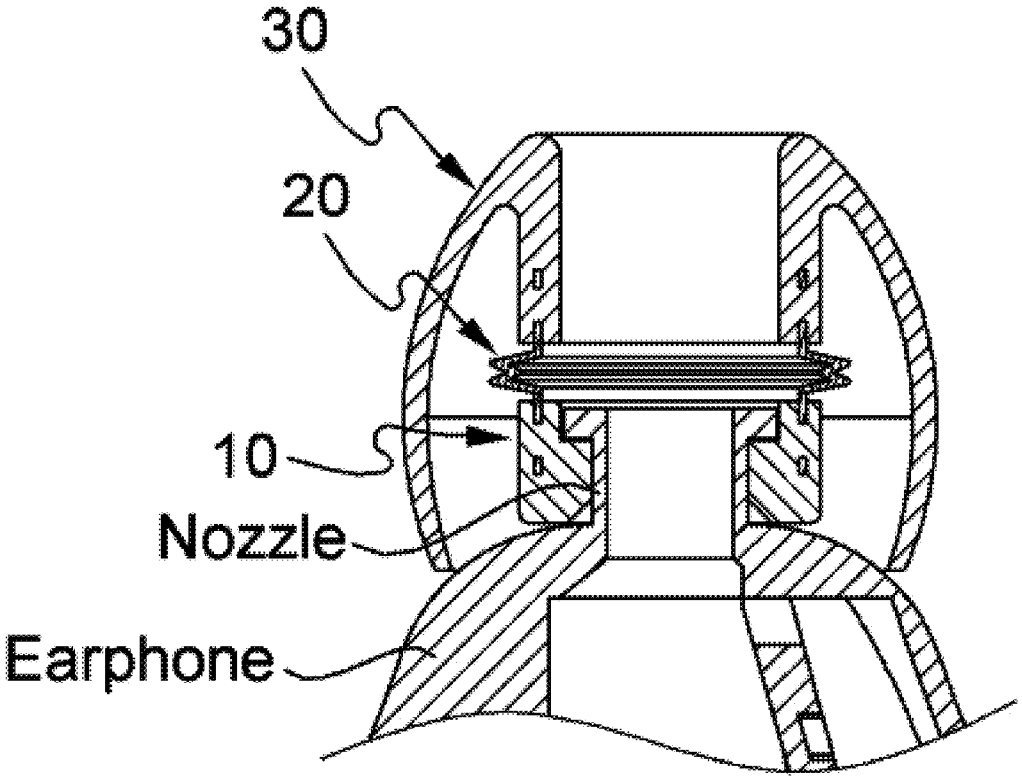
FIGS. 4A, 4B, 4C and 4D are cross-sectional views illustrating the eartip according to one embodiment of the present invention which is mounted on an earphone and illustrate examples of a length and an angle being adjusted according to the earphone.
Figure 4B:
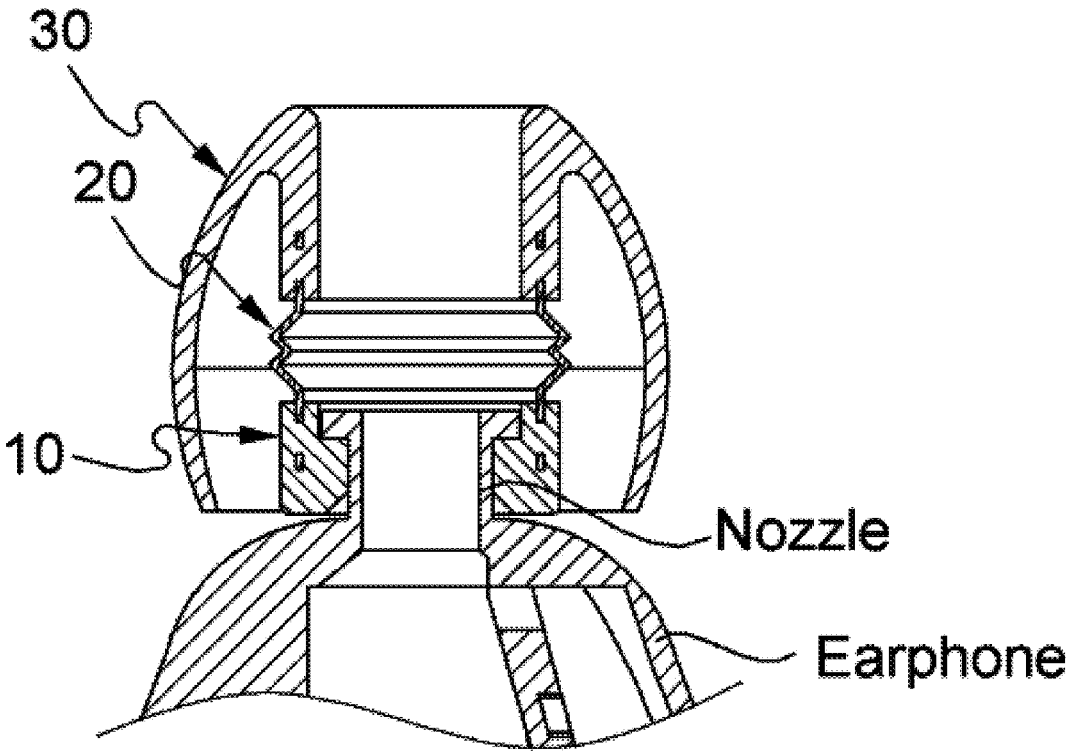
Figure 4C:
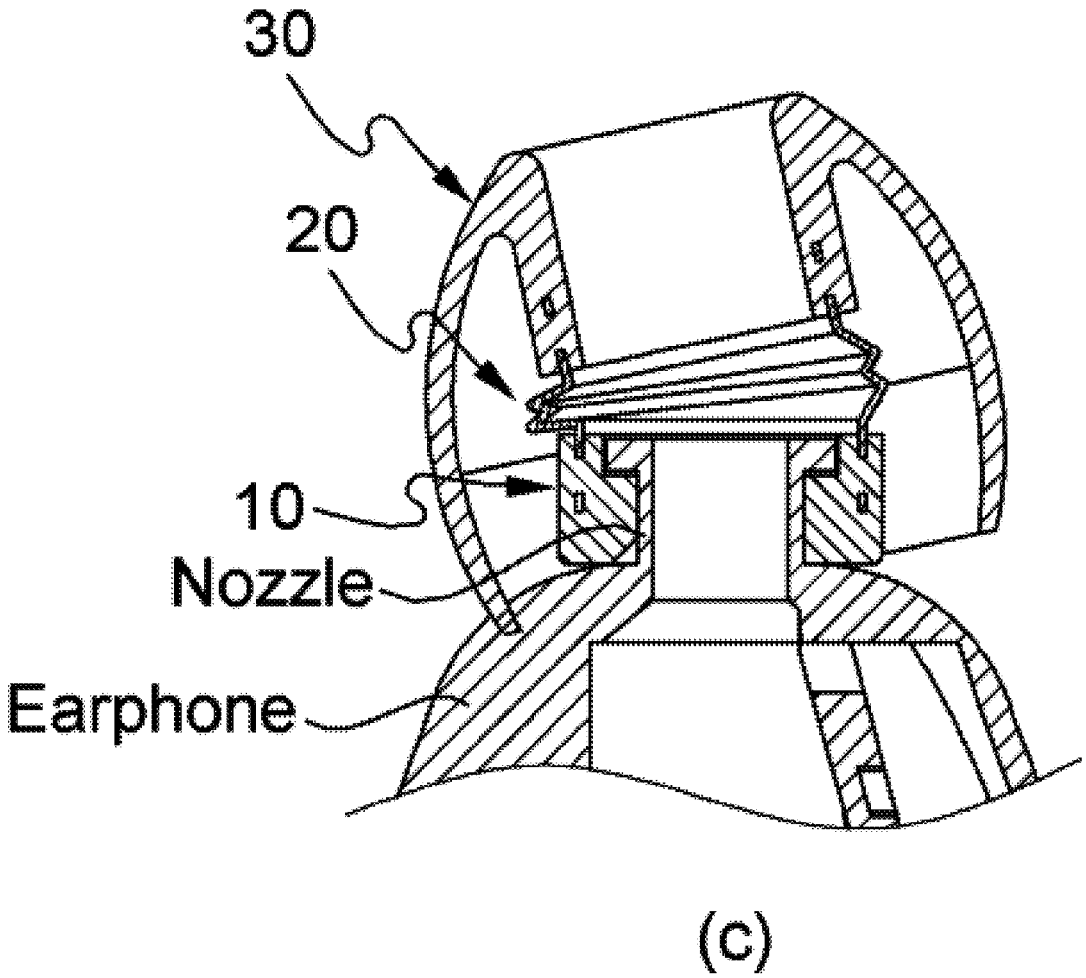
Figure 4D:
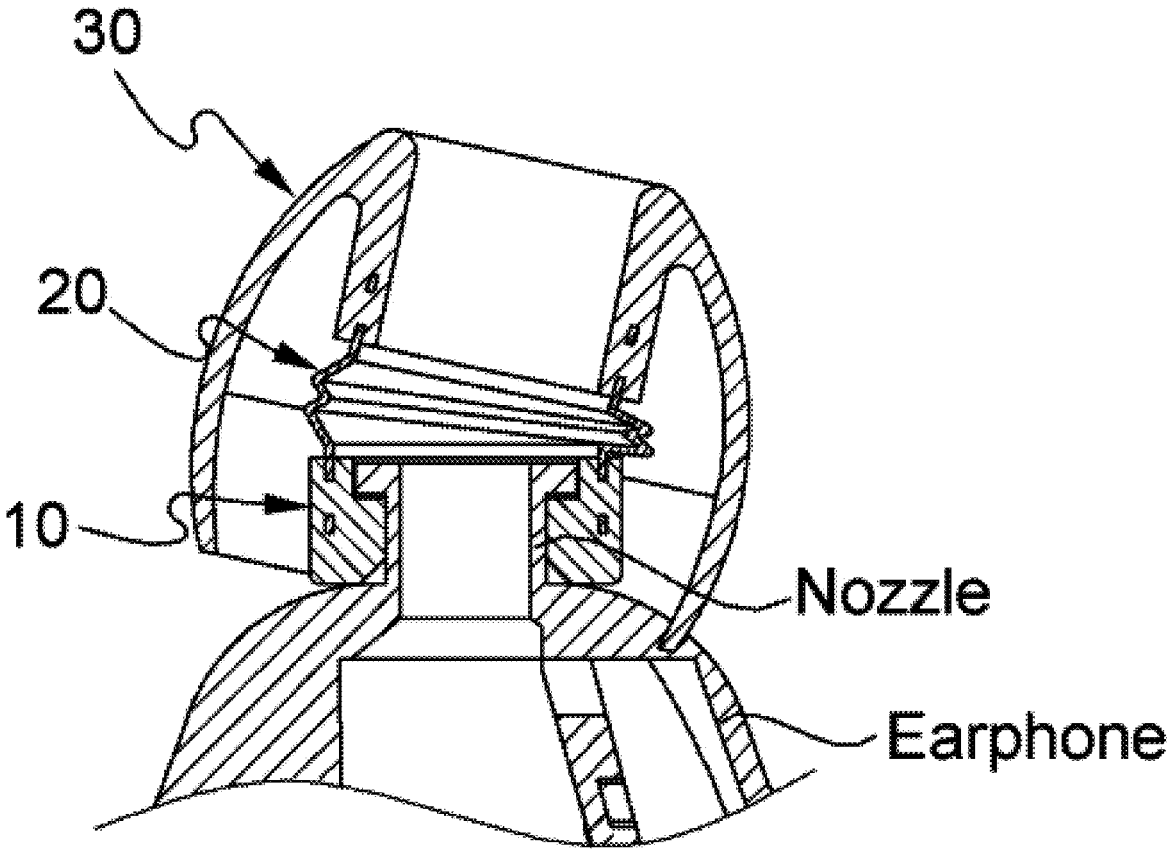

FIG. 4A illustrates an eartip having a basic shape. Here, when the contact portion 30 is pulled, as shown in FIG. 4B, a length of the variable portion 20 increases so that an overall length of the eartip may increase. When a force is applied to the contact portion 30 laterally or a user inserts the eartip into the external auditory meatus, the variable portion 20 may be bent by a force applied to the eartip caused by contact with the external auditory meatus so that an angle of the eartip with respect to the earphone may be adjusted as shown in FIGS. 4C and 4D.

FIGS. 5A to 5E are plan views of the eartip mounted on the earphone and illustrate examples of the angle with respect to the earphone being adjusted.

Figure 5A:
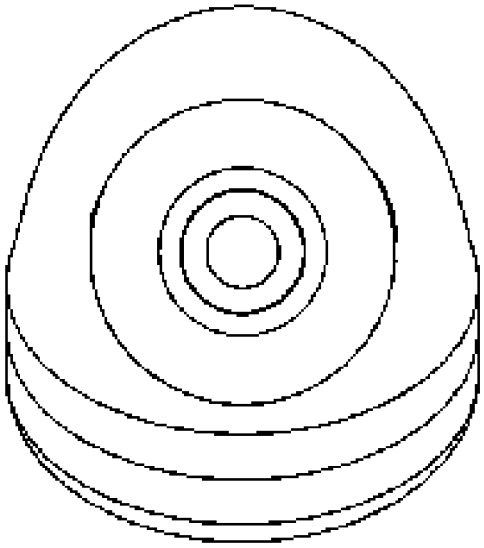
FIGS. 5A, 5B, 5C, 5D and 5E are plan views of the eartip mounted on the earphone and illustrate examples of an angle with respect to the earphone being adjusted.
Figure 5B:
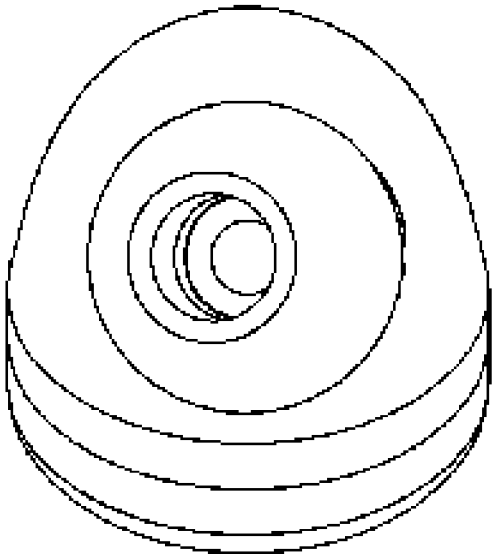
Figure 5C:
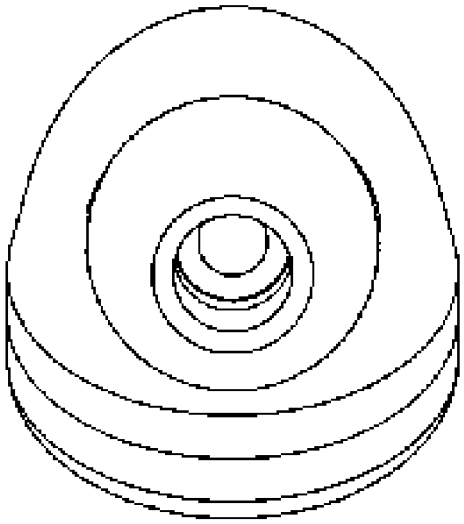
Figure 5D:
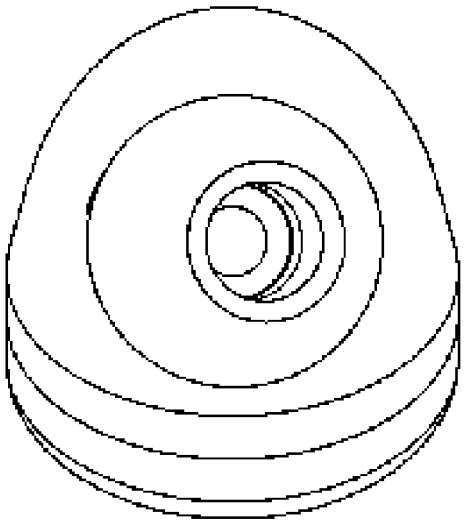
Figure 5E:
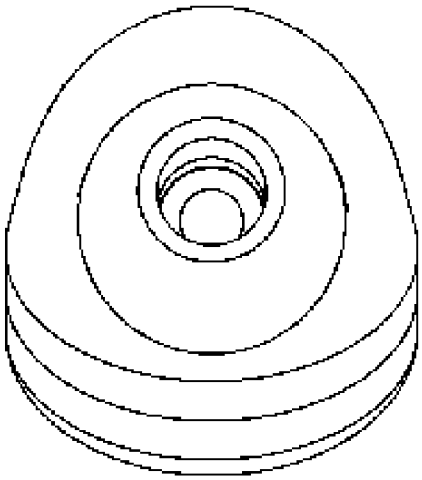

FIG. 5A illustrates an eartip having a basic shape. When a force is applied to the eartip laterally or the user inserts the eartip into the external auditory meatus, the angle of the eartip with respect to the earphone may be adjusted in all desired directions by a force applied to the eartip caused by contact with the external auditory meatus as shown in FIGS. 5B, 5C, 5D, and 5E.

Figure 6A:
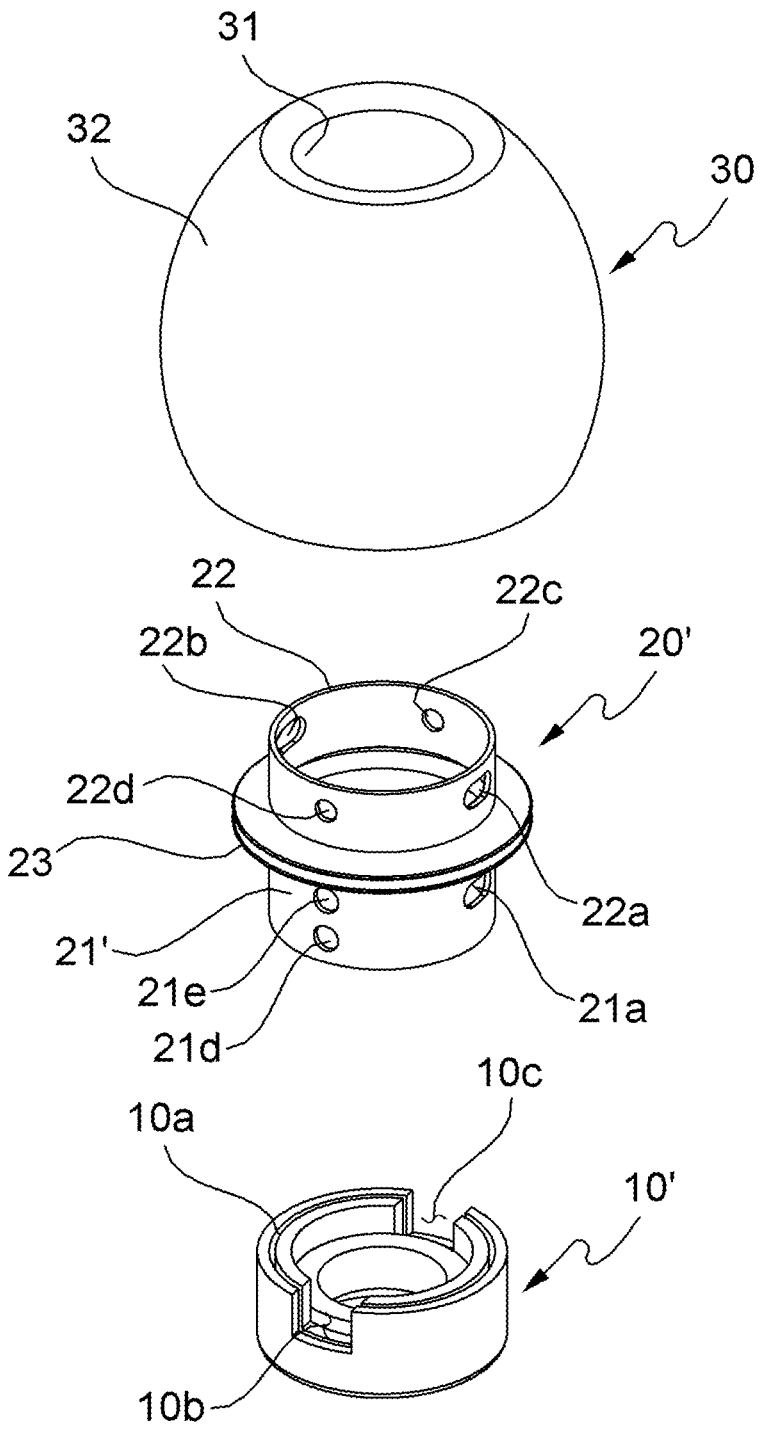
FIG. 6A is an exploded perspective view illustrating an eartip according to another embodiment of the present invention when viewed from above.
Figure 6B:
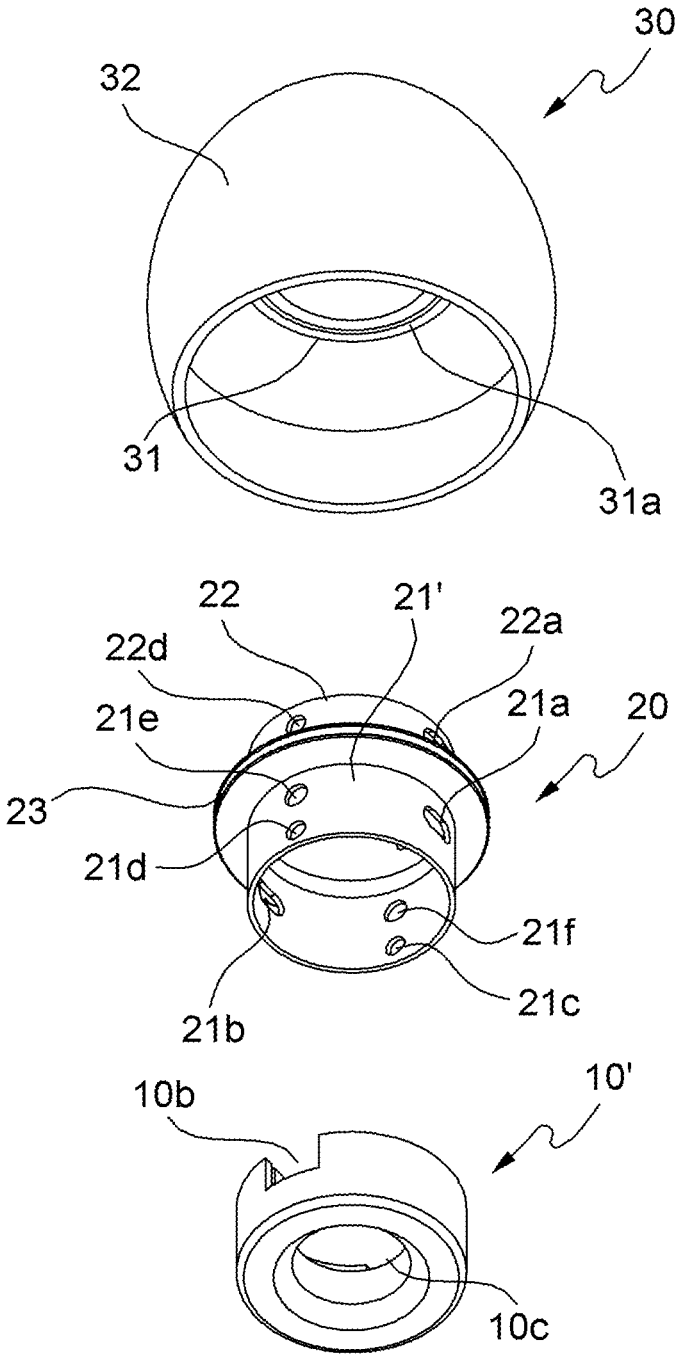
FIG. 6B is an exploded perspective view illustrating the eartip according to another embodiment of the present invention when viewed from below.
Figure 7:
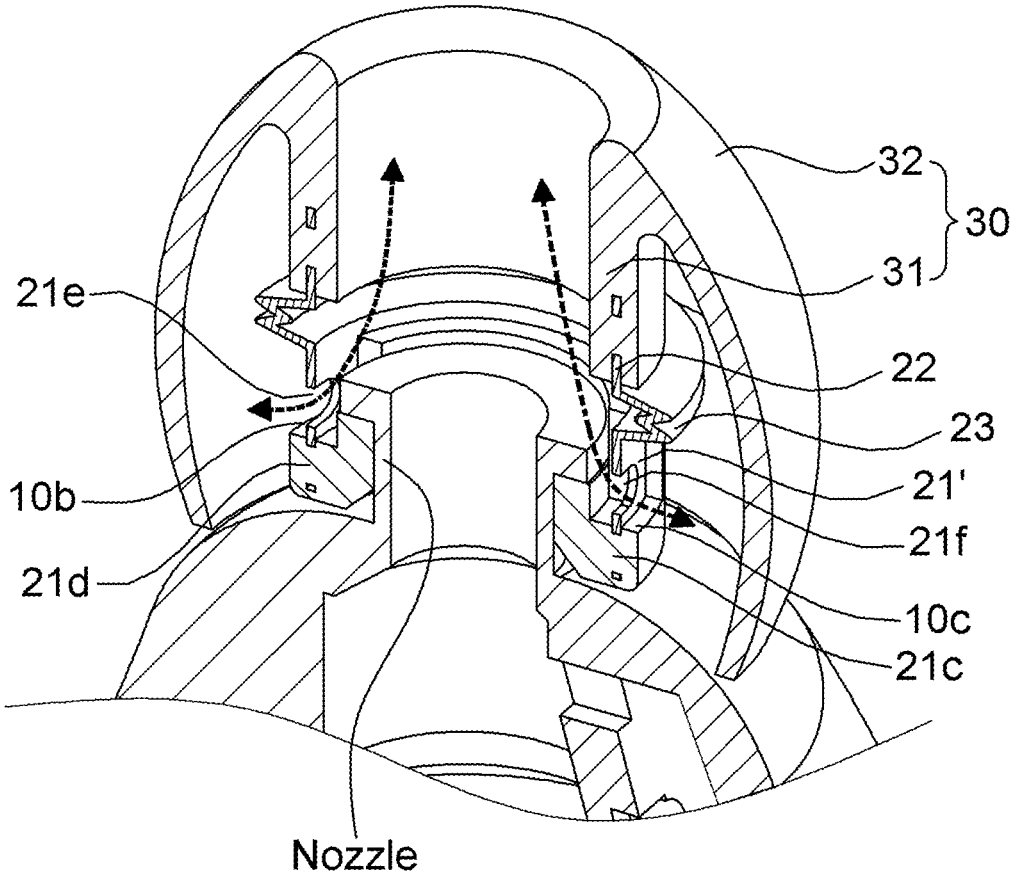
FIG. 7 is a cross-sectional perspective view of the eartip according to another embodiment of the present invention which is mounted on an earphone.

FIGS. 6A to 7 are views of an eartip according to another embodiment of the present invention. FIG. 6A is an exploded perspective view of the eartip when viewed from above, FIG. 6B is an exploded perspective view of the eartip when viewed from below, and FIG. 7 is a cross-sectional perspective view of the eartip mounted on an earphone. Hereinafter, for convenience, only differences from the above-described embodiment will be mainly described.

A fixing portion 10' includes groove portions 10*b* and 10*c* recessed from top ends of one or more side surfaces so that a cylindrical inside communicates with an outside through the groove portions 10*b* and 10*c*. Also, a first section 21' of a variable portion 20' includes holes 21*e* and 21*f* formed at parts corresponding to the groove portions 10*b* and 10*c*. The holes 21*e* and 21*f* of the groove portions 10*b* and 10*c* may relieve unfamiliarity that a wearer of the earphone can feel due to an increase in internal pressure caused by sealing an external auditory meatus and an internal space of the earphone. Referring to FIG. 7, the external auditory meatus (or the internal space of the earphone) and a space outside the earphone may communicate with each other through the holes 21*e* and 21*f* so as to prevent the external auditory meatus and the space inside the earphone from being sealed. According to an embodiment, a mesh member (not shown) configured to cover the holes 21*e* and 21*f* may be provided to prevent water or a foreign substance from flowing through the holes 21*e* and 21*f* or to adjust a pressure difference between the inside of the earphone and the space outside the earphone.

According to the present invention, a variable eartip configured to provide user-customized wearability and comfortability by adjusting a length and an angle of the eartip to be adequate for an earphone may be provided.

The exemplary embodiments of the present invention have been described above. It should be understood by one of ordinary skill in the art that the present invention may be implemented as a modified form without departing from the essential features of the present invention. Therefore, the disclosed embodiments should be considered not in a limitative view but a descriptive view. The scope of the present invention will be shown in the claims not in the above description, and all differences within an equivalent range thereof should be construed as being included in the present invention.

What is claimed is:

1. An eartip for an earphone, comprising:

a fixing portion formed to have a cylindrical shape with a bottom fixedly coupled to a nozzle of an earphone;

a variable portion formed to have a cylindrical shape with a bottom coupled to a top of the fixing portion and to have a length and bending which are variable; and a contact portion formed of a flexible material and comprising an inner section having a cylindrical shape with a bottom coupled to a top of the variable portion and an outer section extending to be rounded downward from a top end of the inner section to surround at least parts of the inner section, the variable portion, and the fixing portion and to come into contact with an external auditory meatus of a user's ear, wherein the variable portion comprises a first section formed below and coupled to the top of the fixing portion, a second section formed above and coupled to a bottom of the inner section, and a third section located between the first section and the second section and having a length and bending which are variable, and wherein the first section is coupled to the fixing portion while being inserted into an insertion groove formed along a periphery of a top end of the fixing portion.

2. The eartip of claim 1, wherein the third section is formed of a corrugated tube.

3. The eartip of claim 1, wherein the first section and the fixing portion are coupled through insertion-injection molding, and the first section comprises one or more holes formed therein.

4. An eartip for an earphone, comprising:

a fixing portion formed to have a cylindrical shape with a bottom fixedly coupled to a nozzle of an earphone;

a variable portion formed to have a cylindrical shape with a bottom coupled to a top of the fixing portion and to have a length and bending which are variable; and a contact portion formed of a flexible material and comprising an inner section having a cylindrical shape with a bottom coupled to a top of the variable portion and an outer section extending to be rounded downward from a top end of the inner section to surround at least parts of the inner section, the variable portion, and the fixing portion and to come into contact with an external auditory meatus of a user's ear, wherein the variable portion comprises a first section formed below and coupled to the top of the fixing portion, a second section formed above and coupled to a bottom of the inner section, and a third section located between the first section and the second section and having a length and bending which are variable, and wherein the second section is coupled to the inner section while being inserted into an insertion groove formed along a periphery of a bottom end of the inner section.

5. The eartip of claim 4, wherein the second section and the inner section are coupled through insertion-injection molding, and the second section comprises one or more holes formed therein.

6. An eartip for an earphone, comprising:

a fixing portion formed to have a cylindrical shape with a bottom fixedly coupled to a nozzle of an earphone;

a variable portion formed to have a cylindrical shape with a bottom coupled to a top of the fixing portion and to have a length and bending which are variable; and a contact portion formed of a flexible material and comprising an inner section having a cylindrical shape with a bottom coupled to a top of the variable portion and an outer section extending to be rounded downward from a top end of the inner section to surround at least parts of the inner section, the variable portion, and the fixing portion and to come into contact with an external auditory meatus of a user's ear, wherein the variable portion comprises a first section formed below and coupled to the top of the fixing portion, a second section formed above and coupled to a bottom of the inner section, and a third section located between the first section and the second section and having a length and bending which are variable, wherein the fixing portion comprises a groove portion recessed in at least one side surface from a top end so that an inside and an outside of the cylindrical shape communicate with each other, and wherein the first section comprises a hole formed in a part corresponding to the groove portion.

7. The eartip of claim 6, wherein the third section is formed of a corrugated tube.

8. The eartip of claim 4, wherein the third section is formed of a corrugated tube.

* * * * *